US005475483A

United States Patent [19]

Isobe

[11] Patent Number: 5,475,483

[45] Date of Patent: Dec. 12, 1995

[54] TONER FIXING APPARATUS USING HEAT GENERATING RESISTANCE FILM

[75] Inventor: Minoru Isobe, Tokyo, Japan

[73] Assignee: Oki Electric Industry Co., Ltd., Tokyo, Japan

[21] Appl. No.: 187,288

[22] Filed: Jan. 27, 1994

[30] Foreign Application Priority Data

Feb. 4, 1993 [JP] Japan ..... 5-017415

[51] Int. Cl.[6] ..... G03G 15/20

[52] U.S. Cl. ..... 355/285; 219/216

[58] Field of Search ..... 355/285, 289, 355/290; 219/216; 432/59

[56] References Cited

U.S. PATENT DOCUMENTS 5,084,738 1/1992 Ishikawa ..... 355/285

5,115,279 5/1992 Nishikawa et al. ..... 355/290

FOREIGN PATENT DOCUMENTS 0050030 9/1992 European Pat. Off. .

61-262774 11/1986 Japan ..... 355/285

62-200380 9/1987 Japan ..... 355/285

*Primary Examiner*—Joan H. Pendegrass

*Attorney, Agent, or Firm*—Steven M. Rabin

[57] ABSTRACT

A resistance film which generates heat when a power is supplied is wound around a roller so that a roller may be rotated. An impression roller, which comes in contact under pressure with the resistance film, is provided and rotated synchronized with the resistance film an opposite direction. A printing form is transferred between and by the resistance film and the depression roller. In this case, toner delivered onto the printing form is fixed by supplying the power to the resistance film. The resistance film can be of an endless type or a web type.

19 Claims, 6 Drawing Sheets

TONER FIXING APPARATUS USING HEAT GENERATING RESISTANCE FILM

CROSS-REFERENCE TO RELATED APPLICATION

This application claims priority benefits under 35 U.S.C. 119, of Japanese Patent Application No. 5-17415 filed Feb. 4, 1993, the entire disclosure of which is incorporated herein by reference.

BACKGROUND OF THE INVENTION

1. Field of the Invention

The present invention relates to a fixing apparatus for fixing toner transferred onto a medium in electronic photograph ic recording equipment such as photocopiers, laser printers and facsimile machines and, more particularly, to a fixing apparatus for melting and fixing toner.

2. Description of the Related Art

For conventional electronic photograph recording equipment, there have been commonly available two types of apparatuses for fixing toner transferred onto a medium; one is a pressure fixing apparatus which pressurizes a medium while passing it between two rollers and the other is a thermal fixing apparatus which fixes toner while applying a pressure to the medium and melting it by heat from the rollers or the like.

In a pressure fixing apparatus which pressurizes the medium with pressure rollers, it is difficult to fix toner on a medium with irregularities, and moreover, a pressure fixing apparatus normally requires excessively large pressure to pressurize a medium, and therefore, a thin medium will be easily broken. Furthermore, to uniformly pressurize a medium in its widthwise direction, the diameter of the pressure rollers should be increased and the bearings which support the pressure rollers should also be large- sized and a large pressure roller driving force is duly required.

On the other hand, in some thermal fixing apparatuses, a heat source is incorporated in respective pressure rollers, or a medium is heated by a xenon lamp or the like without touching the medium. However, thermal fixing apparatuses will require a large capacity heat source and consume significantly large amounts power. Therefore, such thermal fixing apparatuses remain in danger of combustion at all times during use. Though these thermal fixing apparatuses are used in large number because they are relatively congenial to any kind of medium, for example, it takes a lot of time to thermally start up the apparatuses, so they cannot fix toner immediately. Moreover, thermal fixing apparatuses require large capacity heat source, and therefore, they are required to have provisions for discharging heat, fire prevention, and safety. As described above, there have been problems which prevent both pressure fixing and thermal fixing apparatuses from being reduced in size.

Under the circumstances, an ideal thermal fixing apparatus which requires less power consumption and is available for instantaneous fixing only by heating a least required part of the medium has been demanded. To satisfy such a demand, an apparatus using a thermal head as a heat source has been proposed. In this type of thermal fixing apparatus, a thermal head is arranged to oppose a medium onto which toner is transferred and the toner is melted by heat from this thermal head. A sheet which moves synchronized with the medium is arranged between the thermal head and the medium so as not to disturb toner before fixing.

In this type of thermal fixing apparatus, however, the sheet arranged between the thermal head and the medium prevents satisfactory heat conduction of heat from the thermal head to the medium. Thermal conductivity can be increased by reducing the thickness of the sheet, but it is technically difficult to thin the sheet because it conflicts with a need to maintain sufficient sheet strength. In short, there has been a problem that efficient conduction of heat from the thermal head to the medium is prevented by this sheet disposed therebetween, thus deteriorating the thermal efficiency.

In addition, a serious problem has arisen that the heating part of the thermal head wears because it is rubbed by a running sheet.

SUMMARY OF THE INVENTION

An object of the present invention is to provide a fixing apparatus whose thermal efficiency is improved by using the maximum possible amount of the heat generated by a heat source in melting toner.

Another object of the present invention is to provide an economical, excellent fixing apparatus which permits improving thermal efficiency and downsizing.

A further object of the present invention is to provide a fixing apparatus whose heat source is free from wear and provides durability.

To attain the above objects, a fixing apparatus according to the present invention is provided with a heat generating resistance film which is arranged to be movable and generates heat when power is supplied, electrodes which supply power to the heat generating resistance film, and pressure-holding members which hold the medium so that the toner bearing surface of the medium is pressed against the heat generating resistance film.

The heat generating resistance film can be made endless (in a loop) or in a sheet. The pressure-holding members can be formed by a pair of rollers and the electrodes can be provided on the roller at the heat generating resistance film side. A plurality of electrodes can be arranged along the widthwise direction of the heat generating resistance film as segments of the roller to be disposed at the heat generating resistance film side, with a low resistance film provided between the heat generating resistance film and the medium.

According to the present invention with the above configuration, the heat generating resistance film generates heat in the nip between the rollers when electrical power is supplied via the electrodes, and the heat generated is directly conducted to toner on the medium in the nip. Therefore, the thermal efficiency is improved.

When the pressure-holding members are formed by a pair of rollers and the electrodes are provided at both ends of the roller at the heat generating resistance film side, a current flows in the widthwise direction of the narrow portion of the heat generating resistance film within the nip, thus causing the heat generating resistance film to generate heat, which is directly conducted to toner on the medium, and the toner is fixed. When the pressure-holding members are formed by a pair of rollers, a plurality of electrodes are arranged as the roller at the heat generating resistance film side in the widthwise direction of the heat generating resistance film, and a low resistance heat conducting film is provided between the heat generating resistance film and the medium, a current flows in the direction of the thickness of the heat generating resistance film between the roller-type electrodes and the low resistance film, thus causing the heat generating resistance film to produce heat, and the toner is fixed.

Since the heat generating resistance film generates heat only when required and is cooled in a relatively short time, the heat discharging mechanism and several types of safety mechanisms can be made simple and compact. Therefore, the printer apparatus can be downsized and low-priced.

DETAILED DESCRIPTION OF THE PREFERRED EMBODIMENTS

Referring to the accompanying drawings, preferred embodiments according to the present invention are described in detail below. Components common to all drawings are given the same number or symbol.

A first embodiment is described below.

Figure 1:
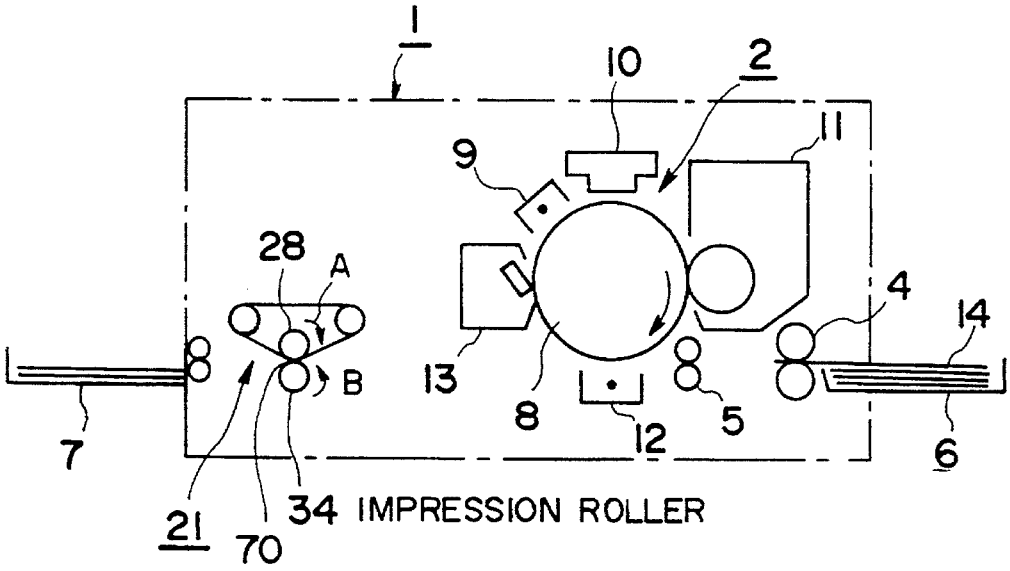
FIG. 1 is a side view schematically showing an electronic photograph printer provided with a fixing apparatus according to a first embodiment.

In FIG. 1, an electronic photograph printer 1 such as a laser printer, having a fixing apparatus of the first embodiment is provided with an electronic photograph recorder 2, form feed rollers 4, and form transfer rollers 5 and further equipped with a form feed cassette 6 and a form ejecting cassette 7. The electronic photograph recorder 2 comprises an exposure drum 8, a charging unit 9, an exposure head 10, a developing unit 11, a transcribing unit 12, and a cleaning unit 13.

In the electronic photograph recorder 2, the surface of the exposure drum 8 is uniformly charged by the charging unit 9 as it rotates, and the exposure head 10 forms an electrostatic latent image according to printing data. The electrostatic latent image is developed by the developing unit 11 and is visualized with toner.

On the other hand, a form 14 which is fed from the form feed cassette 6 by the form feed rollers 4 is transferred by the form transfer rollers 5 to a printing position. A toner image formed on the exposure drum 8 is transcribed onto the form 14 by the transcribing unit 12. Then the form 14 is transferred to the developing unit 11. The fixing apparatus fixes toner on the form 14, which is then ejected into the form ejecting cassette 7.

Figure 2:
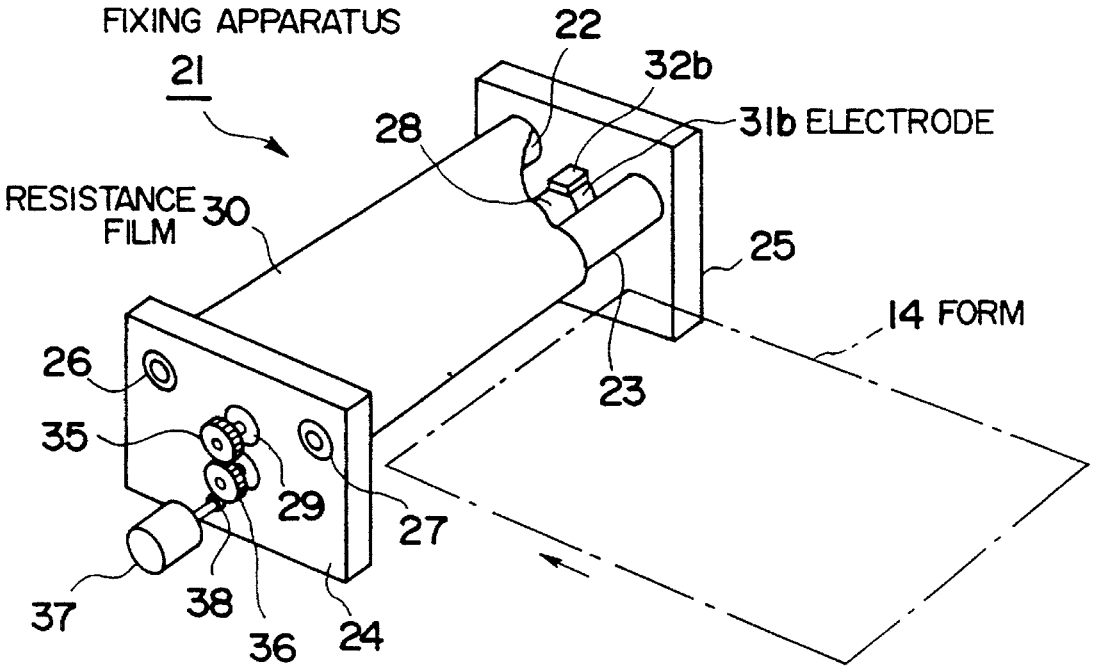
FIG. 2 is a partly cutaway perspective view showing the fixing apparatus of the first embodiment according to the present invention.

In FIG. 2, rollers 22 and 23 are mounted through bearings 26 and 27 to frames 24 and 25 of the fixing apparatus 21 so that the rollers 22 and 23 are rotatable. A roller 28 which is made of an insulator is also installed through a bearing 29 to the frames 24 and 25 so that the roller 28 is rotatable. An endless, thin resistance film 30 is wound in a loop around these three rollers 22, 23, and 28. The resistance film 30 which is a little wider than the form 14 is made of a material which has a high resistance in the range of 50 to 400Ω and generates heat when the power (electrical current) is supplied, e.g., Ni and Cr, Ta and Ni, or Ta and Si. When the resistance film 30 generates heat, it reaches a temperature (150° to 170° C.) sufficient to melt toner.

Figure 3:
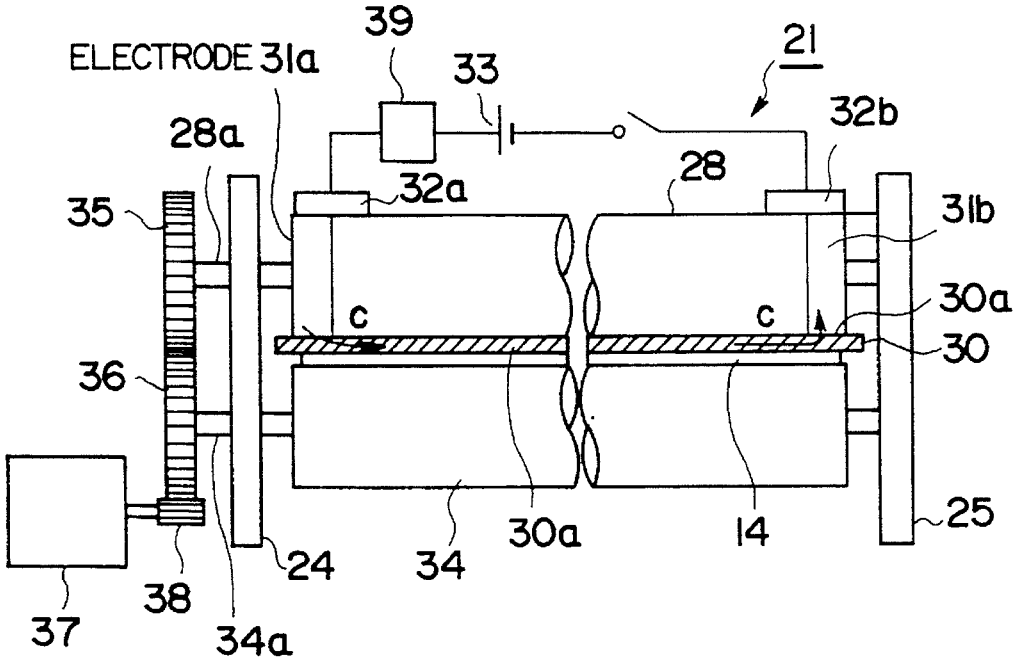
FIG. 3 is an illustration showing a main unit of the fixing apparatus according to the first embodiment.

In FIGS. 2 and 3, means for applying electrical current to the film 30 are provided as electrodes **31*a* and 31*b* at both ends of the roller 28, and brushes 32*a* and 32*b* arranged above and in contact with the electrodes 31*a* and 31*b*, respectively. The brushes 32*a* and 32*b* are connected through a control part 39 to a power supply 33. An impression or pressure roller 34 is provided below the roller 28. The resistance film 30 and the form 14 onto which the toner is transferred are held at a nip 70 between the roller 28 and the impression roller 34 in slidable contact with the electrodes 31*a* and 31*b*. According to a control signal from the control part 39, a current from the electrodes 31*a* and 31*b* is applied to the resistance film 30**.

Gears 35 and 36 which are mounted on the shaft **28*a* of the roller 28 and the shaft 34*a* of the impression roller 34, respectively, are engaged with each other. The gear 36 is engaged with a gear 38 of a motor 37. When the motor 37 rotates, the roller 28 and the impression roller 34 rotate in synchronism at the same speed in opposite directions. When the roller 28 and the impression roller 34 rotate, the resistance film 30 and the form 14** are transferred synchronized with each other.

The operation of the first embodiment is described below.

In FIG. 1, the form 14 fed from the form feed cassette 6 by the form feed rollers 4 is transferred by the form transfer rollers 5 to a toner transcribing position. A toner image formed on the exposure drum 8 through a sequential electronic photograph process is transcribed onto the form 14 by the transcribing unit 12. Then the form 14 is transferred to the fixing apparatus 21.

In FIGS. 2 and 3, in the fixing apparatus 21, the motor 37 rotates the roller 28 and the impression roller 34 in the arrowhead directions A and B shown in FIG. 1, respectively. The power supply 33 and the control part 39 in FIG. 3 apply a voltage (current) to the electrodes **31*a* and 31*b* through brushes 32*a* and 32*b* so that a current flows through the resistance film 30. The current flows from the electrode 31*a* through the resistance film 30 to the electrode 31*b* in the arrowhead direction C shown in FIG. 3, that is, in the widthwise direction of the resistance film 30. This causes the resistance film 30** to generate heat.

As shown in FIG. 2, the form 14 onto which the toner is transferred finds its way between the resistance film 30 and the impression roller 34 while the resistance film 30 is generating heat. The form 14 is transferred at the same speed as the resistance film 30 while being held at the nip 70 between the resistance film 30 and the impression roller 34. The form 14 is depressed against the contact part **30*a* which is generating heat, and the toner on the form 14 is melted by heat generated from the contact part 30*a* and fixed on the form 14**.

As described above, in the first embodiment, the thermal efficiency is satisfactory because heat generated from the resistance film 30 is directly conducted to the toner on the form 14. Moreover, since the resistance film 30 and the roller 28 rotate synchronized with each other, the resistance film 30 does not wear. In addition, since the resistance film 30 comes into contact with the toner transcribing surface (upper surface in FIG. 3) of the form 14, toner is not disturbed before fixing. Furthermore, since the resistance film 30 generates heat only when required and is cooled in a relatively short time, the heat discharging mechanism and other safety mechanisms can be made simple and compact, thus enabling the printer apparatus to be downsized and low-priced.

Figure 4:
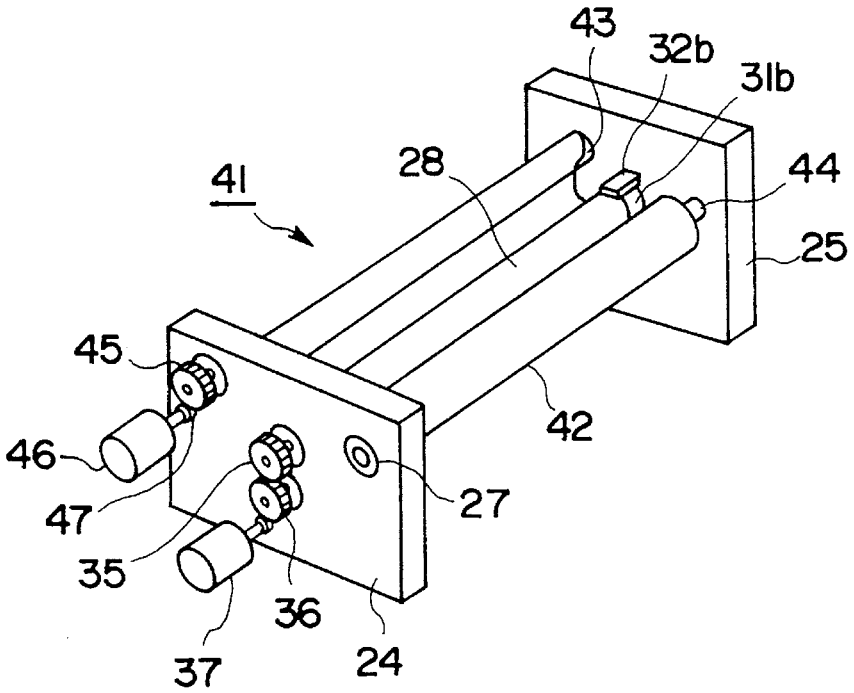
FIG. 4 is a partly cutaway perspective view showing a fixing apparatus according to a second embodiment.

Referring to FIG. 4, a second embodiment according to the present invention is described below.

In the fixing apparatus 41 according to the second embodiment shown in FIG. 4, a resistance film 42, which provides a high resistance and generates heat as in the case of the first embodiment when power is supplied is made as a web (elongated sheet) and is wound around a takeup roller 43 and an unwinding roller 44. The takeup roller 43 is rotatably supported by frames 24 and 25, and a gear 45 which is mounted on the shaft of the takeup roller 43 and is engaged with a gear 47 of a motor 46; that is, the takeup roller 43 is rotated by the motor 46.

The unwinding roller 44 is rotatably mounted with a bearing 27 on the frames 24 and 25. The resistance film 42 which is wound around the takeup roller 43 and the unwinding roller 44 is arranged so that the resistance film 42 comes into contact with electrodes 31*a* and 31*b* below a roller 28. An impression (pressure) roller 34 is provided through the resistance film 42 below the roller 28 as in the case of the first embodiment. The form 14 onto which the toner is transcribed is transferred to find its way between the impression roller 34 and the resistance film 42. Otherwise, the arrangement of the fixing apparatus of the second embodiment is the same as the first embodiment.

The motor 46 is controlled so that its rotation is synchronized with the transfer speed of the resistance film 42 transferred by the rotating roller 28. The resistance film 42 is wound around the takeup roller 43 as the motor 46 rotates and is gradually fed from the unwinding roller 44. The power from the electrodes 31*a* and 31*b* is supplied to the resistance film 42 below the roller 28, and the resistance film 42 generates heat to melt toner on the form 14. Thus molten toner is fixed.

The second embodiment of the arrangement as described above exhibits the same effect as the first embodiment.

Figure 5:
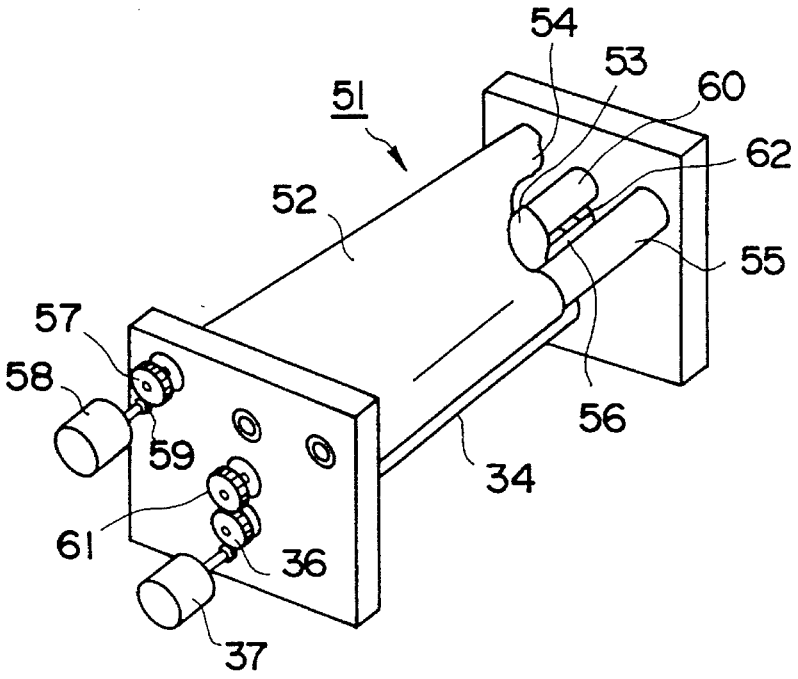
FIG. 5 is a partly cutaway perspective view showing a fixing apparatus according to a third embodiment.
Figure 6:
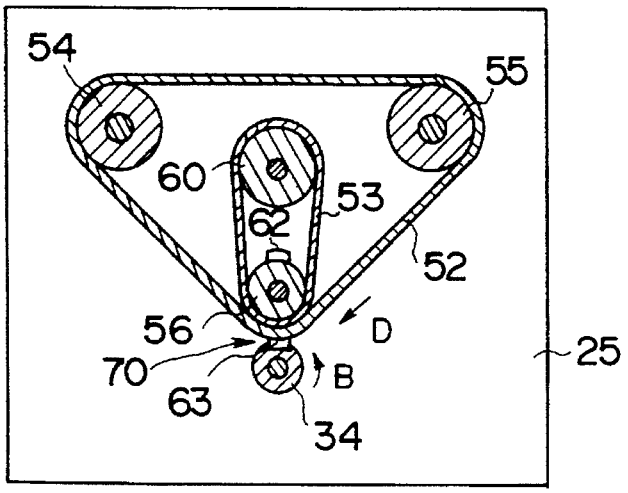
FIG. 6 is a cross-sectional view showing the fixing apparatus according to the third embodiment.
Figure 7:
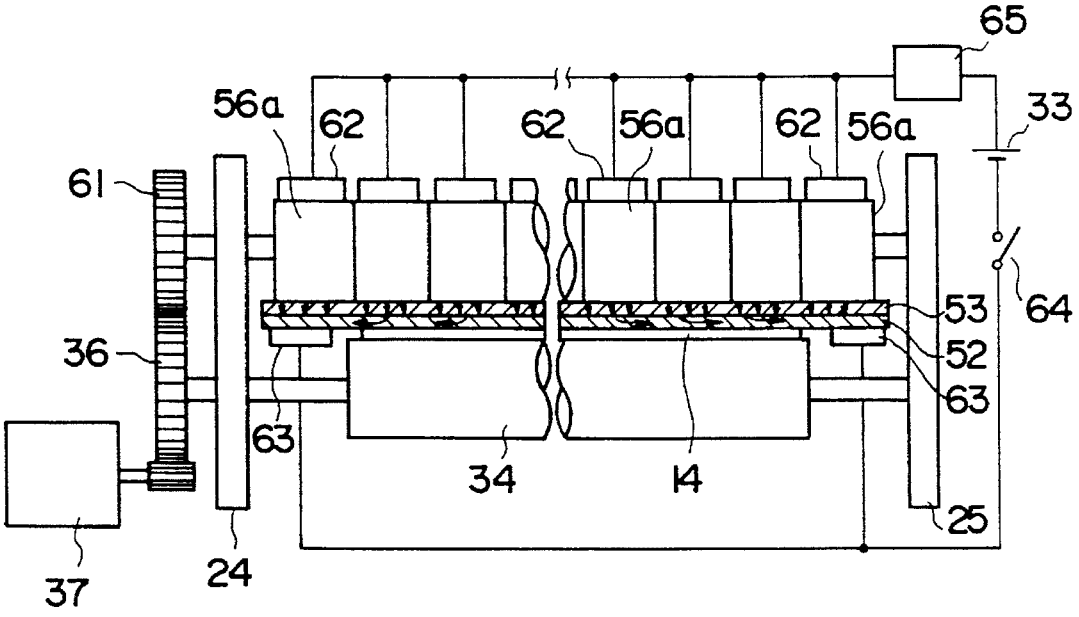
FIG. 7 is an illustration showing a main unit of the fixing apparatus according to the third embodiment.

Referring to FIGS. 5, 6, and 7, a third embodiment according to the present invention is described below.

In FIGS. 5 and 6, a fixing apparatus of the third embodiment is provided with two resistance films 52 and 53 formed in separate loops. The resistance film 52 which is made of a material having a low resistance and high heat conductivity, such as, for example, aluminum or a copper alloy, extends under tension around tension rollers 54 and 55 and an electrode roller 56. The tension rollers 54 and 55 and the electrode roller 56 are rotatably supported by frames 24 and 25. A gear 57 mounted on the shaft of the tension roller 54 is engaged with a gear 59 connected to a motor 58. In other words, the tension roller 54 is rotated by the motor 58. The low resistance film 52 is moved around the tension rollers 54 and 55 and the electrode roller 56.

The resistance film 53 with a high resistance value, which is made of the same material as the resistance films 30 and 42 in the first and second embodiments, extends between a tension roller 60 and the electrode roller 56 so as to contact the low resistance film 52 only at the electrode roller 56. A gear 61 which is mounted on the shaft of the electrode roller 56 is engaged with a gear 36 mounted on an impression roller 34 and is rotated by a motor 37. The motors 58 and 37 are controlled so that the high resistance film 53 and the low resistance film 52 are transferred at the same speed. The form 14 onto which the toner is transferred is guided between the low resistance film 52 and the impression roller 34 with the toner bearing surface of the form facing the low resistance film.

Referring to FIG. 7, the electrode roller 56 is described below.

The electrode roller 56 which is rotatably supported by the frames 24 and 25 comprises an assembly of a plurality of axially aligned electrode segments or first electrodes 56*a* of identical size which are slightly separated by insulators in the form of thin shield plates, not shown, to prevent a current from flowing between the electrode segments 56*a*. Brushes 62 are provided so that they respectively come into sliding contact with an electrode segment 56*a*. The brushes 62 are connected in parallel with a power supply 33. Since the electrode segments 56*a* are each in contact with the high resistance film 53, a current from the power supply 33 flows via the brushes 62 and the electrode segments 56*a* in the direction of the thickness of the high resistance film 53 over the entire range of its width. Power from the power supply 33 is selectively controlled by a power control part 65 in terms of time and position.

Second electrodes in the form of brushes 63 are provided below both ends of the low resistance film 52 so that they come into contact with the low resistance film 52 in the nip 70. The brushes 63 are connected through a switch 64 to the power supply 33.

The operation of the third embodiment is described below.

The form 14 onto which a toner image is transcribed is transferred to a fixing apparatus 51 and is guided between the low resistant film 52 and the impression roller 34. At this time, the low resistance film 52 is already driven by a motor 58 in the arrowhead direction D shown in FIG. 6 and the impression roller 34 is already rotated by the motor 37 in the arrowhead direction B shown in FIG. 6. The current from the power supply 33 is applied to each of the electrode segments 56*a* comprising the electrode roller 56.

In FIG. 7, a current flows from the electrode segments 56*a* to the high resistance film 53 and further from the high resistance film 53 to the low resistance film 52. In other words, as shown in FIG. 7, a current flows through the high resistance film 53 in the direction of its thickness, thus causing the high resistance film 53 to generate heat. A current flowing in such a manner, even if its amount is relatively small, allows the high resistance film 53 to generate heat; that is, the heat generation efficiency of the high resistance film 53 is increased. A current from the high resistance film 53 to the low resistance film 52 flows through the low resistance film 52 in its widthwise direction to the brushes 63. Heat generated by the high resistance film 53 melts toner on the form 14, and molten toner is fixed.

It is preferable that the electrode segments 56*a* comprising the electrode roller 56 be made as small as possible; however, the size of the electrode segments 56*a* can be appropriately determined because of restrictions on electrode fabrication.

Figure 8:
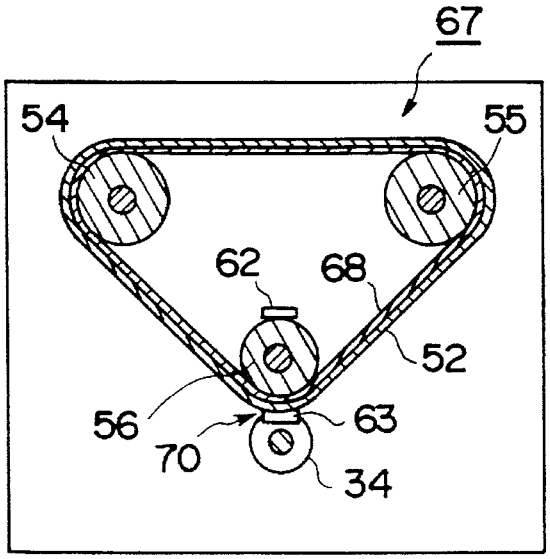
FIG. 8 is a cross-sectional view showing a fixing apparatus according to a fourth embodiment.

Referring to FIG. 8, a fourth embodiment according to the present invention is described below.

In the fixing apparatus of the fourth embodiment shown in FIG. 8, a high resistance film 68 and a low resistance film 52 are formed integral with each other are wound on a tension roller 54, a tension roller 55, and an electrode roller 56 with the high resistance film 68 inside. Brushes 63 are provided so that they come in contact with the low resistance film 52. Otherwise, the arrangement of the fourth embodiment is the same as in the case of the third embodiment.

In the fourth embodiment, as in the third embodiment, the high resistance film 68 generates heat when a current applied from the electrode roller 56 flows through the high resistance film 68 in the direction of its thickness. The heat generated causes the toner to be fixed. The fourth embodiment has a simpler structure than the third embodiment because the former has a reduced number of rollers on which the high resistance film 68 is wound, compared with the latter.

Figure 9:
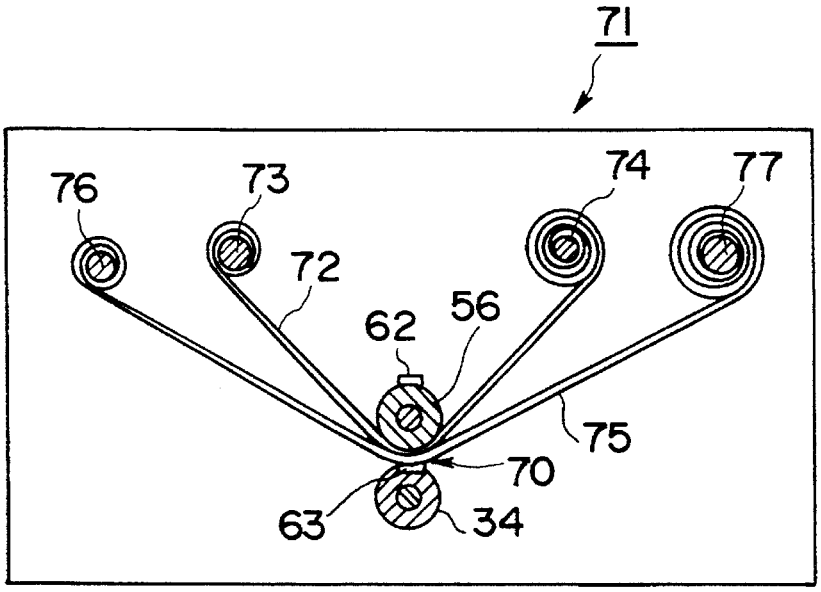
FIG. 9 is a cross-sectional view showing a fixing apparatus according to a fifth embodiment.

Referring to FIG. 9, a fifth embodiment according to the present invention is described.

In FIG. 9, the fixing apparatus 71 of the fifth embodiment has high and low resistance films as in the cases of the third and fourth embodiments and both resistance films are made as a web in elongated sheets. In other words, the high resistance film 72 which is wound around a takeup roller 73 and an unwinding roller 74 is intended to be wound up around the takeup roller 73, which is rotated by a motor not shown. The low resistance film 75 which is wound around a takeup roller 76 and an unwinding roller 77 below the high resistance film 72 is intended to be rolled around the takeup roller 76, which is rotated by the motor not shown. The high resistance film 72 is made of the same material as those of the above-described embodiments and the low resistance film 75 is made of the same material as that of the third embodiment.

Both resistance films 72 and 75, which are sandwiched between an electrode roller 56 and an impression roller 34, are transferred at the same speed. The form 14 onto which toner is transferred is guided between the low resistance film 75 and the impression roller 34. The electrode roller 56, which comprises a plurality of electrode segments as in the case of the third embodiment, generates heat to melt and fix the toner when a current is applied to the electrode roller 56.

It goes without saying that the fifth embodiment thus configured has the same effect as the above-described third and fourth embodiments.

Figure 10:
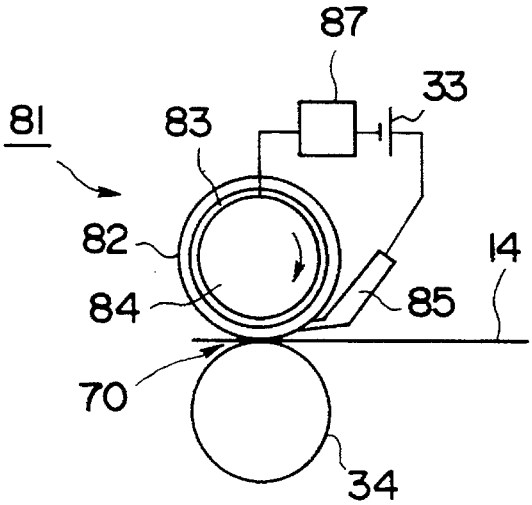
FIG. 10 is an illustration showing a fixing apparatus according to a sixth embodiment.
Figure 11:
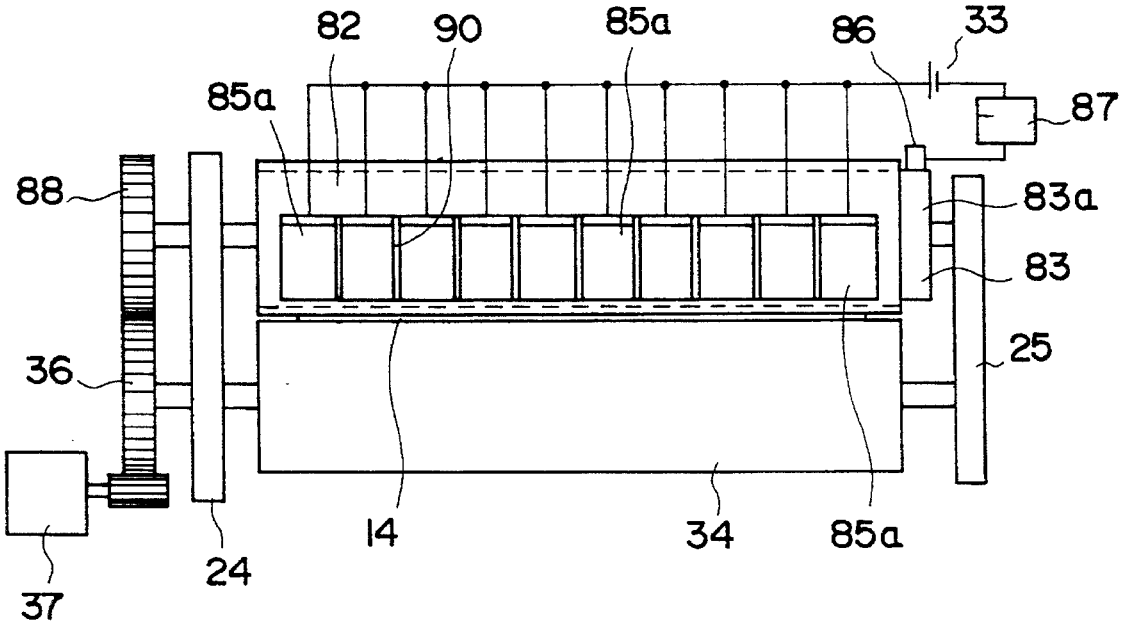
FIG. 11 is an illustration showing a main unit of the fixing apparatus according to the sixth embodiment.

Referring to FIGS. 10 and 11, a fixing apparatus of a sixth embodiment according to the present invention is described below.

In the fixing apparatus of the sixth embodiment of FIGS. 10 and 11, a high resistance film 82 and a low resistance film 83 are formed integral with each other with the high resistance film 82 located outside, and the high resistance film 82 is brought into contact with a divided electrode 85. The high resistance film 82 which is made of the same material as those of the above embodiments generates heat when power is supplied. The low resistance film 83 is made of aluminum or the like as those of the above embodiments. A roller 84 which is rotatably supported by frames 24 and 25 is attached with a gear 88. This gear 88, which is engaged with a gear 36 mounted on the impression roller 34, is rotated by the motor 37 in the arrowhead direction shown in FIG. 10 and transfers the form 14 together with the impression roller 34.

As shown in FIG. 11, the electrode 85 consists of a plurality of electrode segments or first electrodes **85*a*, arranged in the lengthwise direction of the roller 84, each being kept in sliding contact with the high resistance film 82 in front of its contact point with the form 14 in the nip 70. Thin insulator in the form of shield plates 90 are provided between the electrode segments 85*a*, as in the case of the third embodiment, so that no current flows between the electrode segments 85*a*. As shown in FIG. 11, one end of the low resistance film 83 protrudes from the high resistance film 82 and a second electrode in the form of a brush 86 is provided in sliding contact with the protruded end 83*a***.

A current applied by the power supply 33 flows from the electrode segments **85*a* to the high resistance film 82. Since the electrode segments 85*a* are provided over the almost entire range of the width of the high resistance film 82, a current flows over the nearly overall width of the high resistance film 82 in the direction of its thickness, thus causing the high resistance film 82 to generate heat. A current flows in the widthwise direction of the high resistance film 82 to the low resistance film 83. The power from the power supply 33 is selectively controlled by an power control part 87** in terms of time and position.

The high resistance film 82 which generates heat in front of its contact point with the form 14 is depressed against the form 14 while generating heat. The high resistance film 82 is depressed against the form 14 to melt the toner on the form 14 and fix thereon.

It is preferable that the low resistance film 83 be formed to be relatively thin to prevent heat generated by the high resistance film 82 from escaping in the circumferential direction of the roller 84. This roller 84 is preferably made of a material, such as, for example, ceramics with a low thermal conductivity.

All the electrode segments **85*a* can be powered at one time, but it is also possible to select the time of current application and the electrode segments to which a current is applied, according to printing data. Power consumption can be reduced by selectively supplying power to the electrode segments 85*a***.

What is claimed is:

1. A fixing apparatus for fixing a toner onto a toner bearing surface of a medium, comprising:

a first roller having opposite ends;

electrodes on said opposite ends;

a second roller closely opposing said first roller so as to define a nip therebetween;

a heat generating resistance film formed in a loop; and means for transporting said film and the medium between said first roller and said second roller with said film in electrical contact with said electrodes in said nip, the medium between said second roller and said film, and the toner bearing surface of the medium facing said film, so that heat is transferred from said film to the toner in said nip, whereby the toner is fused to the toner bearing surface of the medium.

2. A fixing apparatus according to claim 1, wherein the film is formed of a material having high resistivity.

3. A fixing apparatus according to claim 2, wherein said material comprises an alloy selected from the group of alloys consisting of Ni/Cr, Ta/Ni and Ta/Si.

4. A fixing apparatus according to claim 1, wherein said first roller is formed of an insulating material, further comprising brush means slidably contacting said electrodes for supplying electrical current to said electrodes.

5. A fixing apparatus according to claim 1, wherein said transporting means includes a first gear connected to said first roller, a second gear connected to said second roller and coupled to said first gear so that said first and second rollers rotate in synchronism when one of said first and second gears is driven in rotation, and a motor for driving said one of said first and second gears in rotation.

6. A fixing apparatus for fixing a toner onto a toner bearing surface of a medium, comprising:

a first roller having opposite ends;

electrodes on said opposite ends;

a second roller closely opposing said first roller so as to define a nip therebetween;

a heat generating resistance film; and means for transporting said film and the medium between said first roller and said second roller with said film in electrical contact with said electrodes in said nip, the medium between said second roller and said film, and the toner bearing surface of the medium facing said film, so that heat is transferred from said film to the toner in said nip, whereby the toner is fused to the toner bearing surface of the medium, wherein said transporting means includes an unwinding roller and a take-up roller connected respectively for feeding and taking up said film.

7. A fixing apparatus according to claim 6, wherein the film is formed of a material having high resistivity.

8. A fixing apparatus according to claim 7, wherein said material comprises an alloy selected from the group of alloys consisting of Ni/Cr, Ta/Ni and Ta/Si.

9. A fixing apparatus according to claim 6, wherein said first roller is formed of an insulating material, and further comprising brush means slidably contacting said electrodes for supplying electrical current to said electrodes.

10. A fixing apparatus according to claim 6, wherein said transporting means includes a first gear connected to said first roller, a second gear connected to said second roller and coupled to said first gear so that said first and second rollers rotate in synchronism when one of said first and second gears is driven in rotation, and a motor for driving said one of said first and second gears in rotation.

11. A fixing apparatus for fixing a toner onto a toner bearing surface of a medium, comprising:

an electrode roller, having a plurality of axially aligned successively adjacent segments, the segments forming respective first electrodes and being insulated from each other;

a pressure roller closely opposing said electrode roller so as to define a nip therebetween;

a heat generating high resistance film movably disposed between said electrode roller and said pressure roller and having a first surface contacting each of said first electrodes;

a heat conducting low resistance film, movably disposed between said pressure roller and said high resistance film, and contacting said high resistance film at least in said nip;

at least one second electrode electrically contacting said low resistance film adjacent to said nip; and means for transporting said high and low resistance films and the medium between said electrode roller and said pressure roller, with the medium between said pressure roller and said low resistance film and the toner bearing surface of the medium in contact with said low resistance film in said nip, whereby heat generated in said high resistance film in said nip is conducted through said low resistance film to the toner bearing surface of the medium, thereby to fuse the toner to the toner bearing surface of the medium.

12. A fixing apparatus according to claim 11, wherein said high and low resistance films are formed in respective first and second loops which contact each other only at said electrode roller.

13. A fixing apparatus according to claim 11, wherein said low resistance film is formed substantially of a material selected from the group of materials consisting of copper alloy and aluminum.

14. A fixing apparatus according to claim 11, wherein said low and high resistance films comprise elongated sheets.

15. A fixing apparatus according to claim 11, wherein said high and low resistance films are integral with each other.

16. A fixing apparatus for fixing a toner onto a toner bearing surface of a medium, comprising:

a resistance roller having a peripheral surface;

a heat conductive low resistance film coating the peripheral surface of said resistance roller;

a heat generating high resistance film coating said low resistance film;

a pressure roller closely opposing said resistance roller so as to define a nip therebetween for receiving the medium with the toner bearing surface facing said high resistance film; and means for applying electrical current to the high resistance film to generate heat in said nip, including a plurality of first electrodes insulated from each other and electrically contacting said high resistance film, and a second electrode electrically contacting said low resistance film.

17. A fixing apparatus according to claim 16, wherein said resistance roller is formed of a material having less thermal conductivity than said high and low resistance films.

18. A fixing apparatus according to claim 17, wherein said material of said resistance roller comprises a ceramic.

19. A fixing apparatus according to claim 16, further comprising switch means for applying electrical current to said first electrodes selectively.

* * * * *